US011311165B2

(12) United States Patent
Li

(10) Patent No.: US 11,311,165 B2
(45) Date of Patent: Apr. 26, 2022

(54) CLEANING DEVICE

(71) Applicant: Hizero Applicances Corporation, Shenzhen (CN)

(72) Inventor: Yang Li, Guangdong (CN)

(73) Assignee: Hizero Appliances Corporation, Shenzhen (CN)

( * ) Notice: Subject to any disclaimer, the term of this patent is extended or adjusted under 35 U.S.C. 154(b) by 818 days.

(21) Appl. No.: 16/098,641

(22) PCT Filed: Feb. 13, 2018

(86) PCT No.: PCT/CN2018/076714
§ 371 (c)(1),
(2) Date: Nov. 2, 2018

(87) PCT Pub. No.: WO2019/157656
PCT Pub. Date: Aug. 22, 2019

(65) Prior Publication Data

US 2021/0235955 A1 Aug. 5, 2021

(51) Int. Cl.
*A47L 11/40* (2006.01)
*A47L 11/292* (2006.01)
*A47L 11/282* (2006.01)

(52) U.S. Cl.
CPC ..... *A47L 11/292* (2013.01); *A47L 11/282* (2013.01); *A47L 11/4016* (2013.01);
(Continued)

(58) Field of Classification Search
CPC ..... A47L 9/28; A47L 11/282; A47L 9/2842; A47L 11/4083
See application file for complete search history.

(56) References Cited

U.S. PATENT DOCUMENTS 6,311,356 B1 11/2001 Wang
7,950,105 B2 5/2011 Elsworthy
(Continued)

FOREIGN PATENT DOCUMENTS

CN 1119515 A 4/1996
CN 2857789 Y 1/2007
(Continued)

OTHER PUBLICATIONS

Great Britain Patent Application No. GB1819604.8, Combined Examination and Search Report dated May 29, 2019.
(Continued)

*Primary Examiner* — Michael D Jennings
(74) *Attorney, Agent, or Firm* — IP Spring

(57) ABSTRACT

A cleaning device is provided. The cleaning device includes a driving roller, a driven roller, a flexible cleaning belt sleeved on the driving roller and the driven roller, a garbage collection box disposed on one side of the cleaning belt, a brush disposed over the garbage collection box, a sewage collection tank, a clean water tank and a water squeezing roller disposed on the side of the cleaning belt. The garbage collection box is provided with a guide plate near one end of the cleaning belt, and the guide plate corresponds to the outer side of the cleaning belt. The sewage collection tank and the clean water tank are located downstream of the garbage collection box along the moving direction of the cleaning belt, and the water squeezing roller corresponds to the sewage collection tank.

19 Claims, 4 Drawing Sheets

(52) U.S. Cl.
CPC ..... *A47L 11/4027* (2013.01); *A47L 11/4047* (2013.01); *A47L 11/4069* (2013.01); *A47L 11/4072* (2013.01); *A47L 11/4083* (2013.01); *A47L 2201/00* (2013.01)

(56) References Cited

U.S. PATENT DOCUMENTS

| | | | | |
|---|---|---|---|---|
| 2008/0169245 | A1* | 7/2008 | Roa-Espinosa | C02F 1/56 210/734 |
| 2008/0178912 | A1* | 7/2008 | Chen | A23B 7/152 134/104.3 |
| 2008/0289142 | A1 | 11/2008 | Elsworthy | |
| 2017/0104900 | A1 | 4/2017 | Kitaya et al. | |
| 2017/0209825 | A1* | 7/2017 | Huang | B01D 47/022 |
| 2018/0206685 | A1 | 7/2018 | Li et al. | |
| 2020/0248082 | A1* | 8/2020 | Trapp | C10J 3/466 |

FOREIGN PATENT DOCUMENTS

| | | | |
|---|---|---|---|
| CN | 101190117 | A | 6/2008 |
| CN | 201814516 | U | 5/2011 |
| CN | 202553817 | U | 11/2012 |
| CN | 203436288 | U | 2/2014 |
| CN | 103961038 | A | 8/2014 |
| CN | 205181250 | U | 4/2016 |
| CN | 105640447 | A | 6/2016 |
| CN | 205625818 | U | 10/2016 |
| CN | 107174170 | A | 9/2017 |
| CN | 107252286 | A | 10/2017 |
| DE | 10020197 | A1 | 11/2001 |
| DE | 202016001593 | U1 | 6/2016 |
| EP | 3238597 | A1 | 11/2017 |
| JP | S61-076397 | | 10/1984 |
| WO | 2008146227 | A1 | 12/2008 |
| WO | 2017059600 | A1 | 4/2017 |

OTHER PUBLICATIONS

Corresponding European patent application No. 18209637.0, Extended European Search Report dated Jul. 29, 2019.

Corresponding Japanese patent application No. 2018-567256, Office Action dated Feb. 25, 2020. English Translation.

CNIPA, First Office Action (with English translation) issued in corresponding Chinese Patent Application No. CN201880032579.6, dated Nov. 2, 2020, 23 pages.

* cited by examiner

CLEANING DEVICE

FIELD OF THE DISCLOSURE

The present disclosure relates to the field of cleaning equipment, and in particular to a cleaning device.

BACKGROUND OF THE DISCLOSURE

Environmental sanitation is an important factor affecting the quality of life. Therefore, with the continuous improvement of people's quality of life requirements, the corresponding requirements for environmental sanitation are getting higher and higher. However, the pressure on modern people's work increases daily, so there is an urgent need to liberate people from heavy cleaning work. Thus, there has been a lot of ground cleaning equipment that seeks to improve environmental sanitation. The traditional cleaning equipment generally works with a motor at the front of the machine to drive the cleaning parts to rotate relative to the ground. However, after the traditional cleaning equipment cleans the floor for a while, it is necessary to manually clean the cleaning parts to continue the floor cleaning. It is highly labor intensive and difficult to ensure that the cleaning work is completed during a single cleaning session due to the longer time it takes to clean and the low cleaning efficiency.

SUMMARY OF THE DISCLOSURE

Based on this, it is necessary to provide a cleaning device with low labor intensity and high cleaning efficiency.

A cleaning device comprising a driving roller, a driven roller, a flexible cleaning belt sleeved on the driving roller and the driven roller, a garbage collection box disposed on one side of the cleaning belt, a brush is disposed above the garbage collection box, a sewage collection tank, a clean water tank and a water squeezing roller disposed at a side of the cleaning belt. The garbage collection box is provided with a guide plate near one end of the cleaning belt, the guide plate corresponding to the outer side of the cleaning belt. The sewage collection tank and the clean water tank are both located downstream of the garbage collection box along the moving direction of the cleaning belt, and the water squeezing roller corresponds to the sewage collection tank.

The cleaning device is provided with a sewage collection tank and a clean water tank. When the cleaning device performs cleaning work, clean water in the clean water tank flows onto the cleaning belt to clean the cleaning belt. Sewage water and excess water on the cleaning belt are squeezed into the sewage collection tank by the water squeezing roller. In this way, the cleaning belt is kept clean and the moisture content of the cleaning belt is maintained, so there is no need to manually clean the cleaning belt, which is beneficial to reduce labor intensity. The cleaning of the ground can be completed during a single cleaning session, the cleaning time is shortened, and the cleaning efficiency of the cleaning device is improved.

In one embodiment, a tension roller is further included, the tension roller being located between the driving roller and the driven roller, the cleaning belt being wound around the tension roller.

In one embodiment, the number of tension rollers is two.

In one embodiment, a load bearing wheel is further disposed under the garbage collection box.

In one of the embodiments, the brush is a roller brush.

In one embodiment, the brush is sleeved on a rotating roller, and one end of the rotating roller is connected to a rotating motor.

In one embodiment, the sewage collection tank is located below the cleaning belt, and the clean water tank is located on a side of the cleaning belt away from the sewage collection tank.

In one embodiment, the sewage collection tank and the clean water tank are both located above the cleaning belt, and the sewage collection tank is located downstream of the clean water tank along the moving direction of the cleaning belt.

In one embodiment, the sewage collection tank is connected to a water pump, the water pump corresponding to a surface of the cleaning belt.

In one embodiment, the sewage collection tank is provided with a water inlet hole toward a side of the cleaning belt.

In one embodiment, one end of the sewage collection tank is provided with a water outlet.

In one embodiment, the clean water tank is provided with a water outlet hole toward one side of the cleaning belt, and one end of the clean water tank is provided with a water inlet.

In one embodiment, the number of water squeezing rollers is two, and the two water squeezing rollers are respectively located on opposite sides of the cleaning belt.

In one embodiment, the sewage collection tank has a convex portion toward a side of the cleaning belt; the number of water squeezing rollers is one, the water squeezing roller is located on the opposite side of the cleaning belt relative to the sewage collection tank, and the water squeezing roller corresponds to the convex portion.

In one embodiment, the guide plate is disposed at a sharp corner away from one end of the garbage collection box.

In one of the embodiments, the guide plate is arranged in an arc shape.

Figure 1:
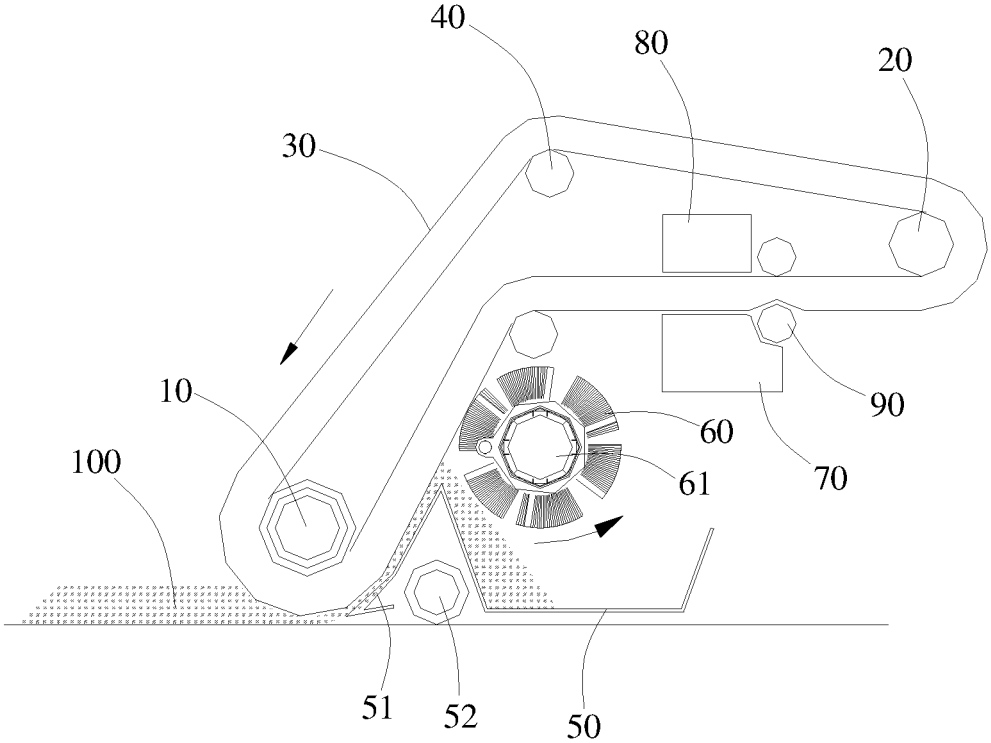
FIG. 1 is a front elevational view of a cleaning device in accordance with a first embodiment of the present disclosure.

The meaning of each label in the drawing is: sewage water 100, driving roller 10, driven roller 20, cleaning belt 30, tension roller 40, garbage collection box 50, guide plate 51, load bearing wheel 5:2, brush 60, rotating roller 61, sewage collection tank 70, water inlet hole 71, water outlet 72, clean water tank 80, water outlet hole 81, water inlet 82, water squeezing roller 90, driving roller 10*a*, driven roller 20*a*, cleaning belt 30*a*, tension roller 40*a*, garbage collection box 50*a*, brush 60*a*, sewage collection tank 70*a*, convex portion 71*a*, clean water tank 80*a*, water squeezing roller 90*a*.

DETAILED DESCRIPTION OF THE EMBODIMENTS

In order to facilitate the understanding of the present disclosure, the present disclosure will be more fully described below. However, the disclosure may be embodied in many different forms and is not limited to the embodiments described herein. Rather, these embodiments are provided so that the understanding of the disclosure will be more thorough.

Unless otherwise defined, all technical and scientific terms used herein have the same meaning. The terminology used in the description of the present disclosure is for the purpose of describing particular embodiments and is not intended to limit the invention.

It should be noted that when an element is referred to as being "fixed" to another element, it may be directly on the other element or an intervening element may be present. When an element is considered to be "connected" to another element, it may be directly connected to the other element or there may be an intervening element. In contrast, when an element is referred to as being "directly on" another element, there is no intervening element. The terms "vertical," "horizontal," "left," "right," and the like, as used herein are for illustrative purposes only.

Figure 2:
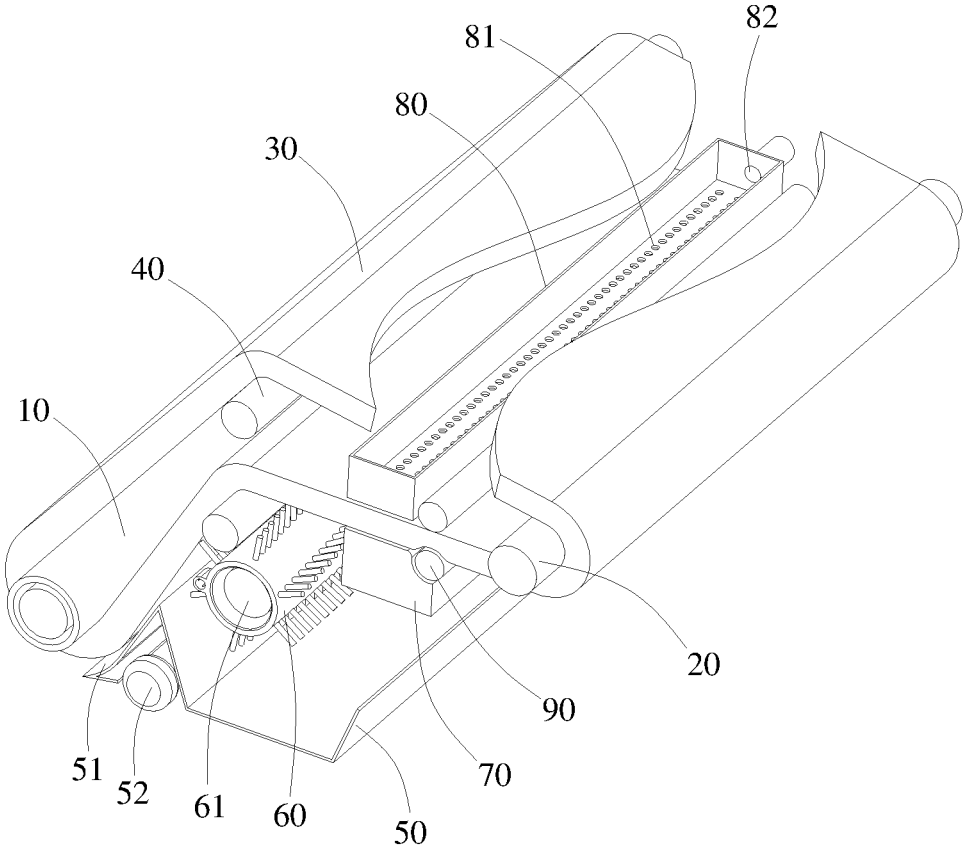
FIG. 2 is a perspective view of the cleaning device of FIG. 1.
Figure 3:
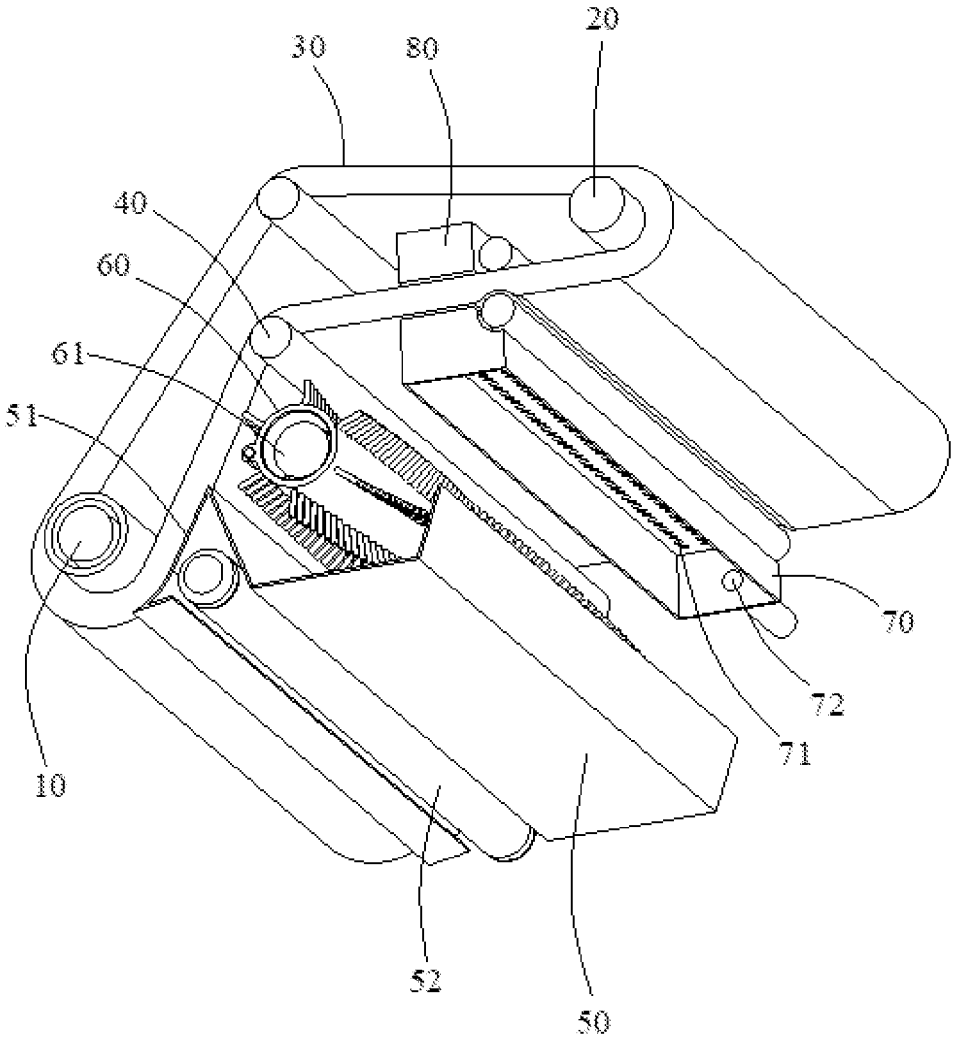
FIG. 3 is a plan view of the cleaning device of FIG. 2.

Referring to FIGS. 1 to 3, a cleaning device according to a first embodiment is provided for cleaning sewage water 100 on the ground. The cleaning device includes a driving roller 10, a driven roller 20, a flexible annular cleaning belt 30 sleeved on the driving roller 10 and the driven roller 20, a tension roller 40, a garbage collection box 50 disposed on one side of the cleaning belt 30, a brush 60 mounted above the garbage collection box 50, a sewage collection tank 70 disposed on the side of the cleaning belt 30, a clean water tank 80 and a water squeezing roller 90.

A driving motor is connected to one end of the driving roller 10, and the driving roller 10 is driven by the driving motor to drive the cleaning belt 30. In this embodiment, the cleaning belt 30 is driven counterclockwise, and the cleaning belt 30 is close to the ground. The garbage on the ground is swept in the direction of the garbage collection box 50. The cleaning belt 30 is made of a flexible material with strong water absorption and strong adhesive force. The flexible material can be rubber, cotton, etc., so that the cleaning belt 30 can absorb the sewage water and dust on the ground. In order to enhance the cleaning effect of the cleaning belt 30, the surface of the cleaning belt 30 may be formed in a wave shape. The tension roller 40 is located between the driving roller 10 and the driven roller 20, and the cleaning belt 30 is wound around the tension roller 40 for adjusting the tightness of the cleaning belt 30. In the present embodiment, the number of tension rollers 40 number is two.

The garbage collection box 50 is used for collecting garbage. The garbage collection box 50 is provided with a guide plate 51 near one end of the cleaning belt 30. The guide plate 51 is disposed in an arc shape. The guide plate 51 corresponds to the outer side of the cleaning belt 30, and the guide plate 51 and the cleaning belt 30 cooperate to guide the garbage into the garbage collection box 50. An end of the guide plate 51 located away from the garbage collection box 50 has a sharp corner, and the garbage is more easily guided into the garbage collection box 50. A load bearing wheel 52 is further disposed under the garbage collection box 50. Specifically, the load bearing wheel 52 is located below the junction of the garbage collection box 50 and the guide plate 51. During operation, the load bearing wheel 52 rolls along the ground, making it easier to move the cleaning device by the load bearing wheel 52.

The brush 60 is located on one side of the cleaning belt 30, and the brush 60 is used for sweeping the garbage adsorbed on the cleaning belt 30 into the garbage collection box 50. In the embodiment, the brush 60 is a roller brush. The brush 60 is connected to a rotating roller 61. One end of the rotating roller 61 is connected with a rotating motor. The rotating roller 61 drives the brush 60 to rotate under the driving force of the rotating motor. Thus, the brush 60 quickly sweeps the garbage on the cleaning belt 30. In this embodiment, the brush 60 rotates counterclockwise.

The sewage collection tank 70 is located downstream of the garbage collection box 50 along the moving direction of the cleaning belt 30. In the present embodiment, the sewage collection tank 70 is located below the cleaning belt 30, and the sewage collection tank 70 is used for storing sewage water. Referring to FIG. 3, the sewage collection tank 70 is provided with a water inlet hole 71 facing toward the side of the cleaning belt 30. The sewage water on the cleaning belt 30 enters into the sewage collection tank 70 from the water inlet hole 71. There is also a water outlet 72 disposed on one end of the sewage collection tank 70, and the sewage water in the sewage collection tank 70 is discharged from the water outlet 72.

The clean water tank 80 is located downstream of the garbage collection box 50 along the moving direction of the cleaning belt 30. The clean water tank 80 is located on the side of the cleaning belt 30 opposite from the sewage collection tank 70, and the clean water tank 80 corresponds to the sewage collection tank 70. The clean water tank 80 is used to store clean water. Referring to FIG. 2, the clean water tank 80 is provided with a water outlet hole 81 facing toward the cleaning belt 30, and the clean water in the clean water tank 80 flows from the water outlet hole 81 onto the cleaning belt 30 for cleaning the cleaning belt 30. One end of the clean water tank 80 is provided with a water inlet 82.

The water squeezing roller 90 corresponds to the sewage collection tank 70. In the present embodiment, the number of the water squeezing rollers 90 is two, and the two water squeezing rollers 90 are respectively located on opposite sides of the cleaning belt 30. The distance between the two water squeezing rollers 90 is smaller than the thickness of the cleaning belt 30 in a free state, and the two water squeezing rollers 90 interact to squeeze the sewage water and excess water on the cleaning belt 30 into the sewage collection tank 70.

Figure 4:
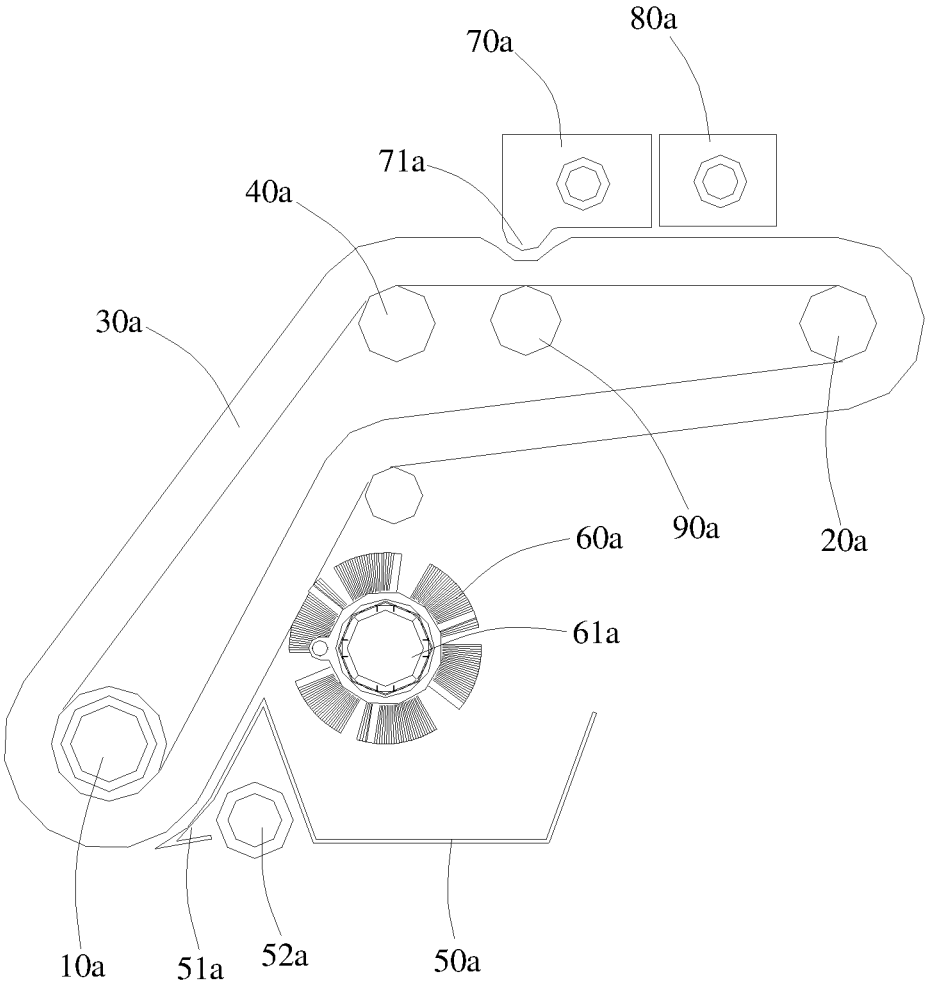
FIG. 4 is a front elevational view of the cleaning device in accordance with a second embodiment of the present disclosure.

Referring to FIG. 4, a cleaning apparatus according to a second embodiment of the present disclosure includes a driving roller 10*a*, a driven roller 20*a*, a flexible cleaning belt 30*a* sleeved on the driving roller 10*a* and the driven roller 20*a*, a tension roller 40*a*, a garbage collection box 50*a* on a side of the cleaning belt 30*a*, a brush 60*a* mounted above the garbage collection box 50*a*, a sewage collection tank 70*a*, a cleaning water tank 80*a*, and a water squeezing roller 90*a* provided on the side of the cleaning belt 30*a*. The difference from the first embodiment is that the sewage collection tank 70*a* and the clean water tank 80*a* are both located above the cleaning belt 30*a*, and the sewage collection tank 70*a* is located downstream of the clean water tank 80*a* along the cleaning belt 30*a*. The sewage collection tank 70*a* is connected with a water pump. The water pump corresponds to the surface of the cleaning belt 30*a*. After the water in the clean water tank 80*a* cleans the cleaning belt 30*a*, the sewage water and excess water on the cleaning belt 30*a* are pumped into the sewage collection tank 70*a* by the water pump. The difference from the first embodiment is that the sewage collection tank 70*a* has a convex portion 71*a* toward the side of the cleaning belt 30*a*, the number of water squeezing rollers 90*a* is one, and the water squeezing roller 90*a* is located on an opposite side of the cleaning belt 30*a* relative to the sewage collection tank 70*a*. The water squeezing roller 90*a* corresponds to the convex portion 71*a*, and the distance between the water squeezing roller 90*a* and the convex portion 71*a* is smaller than the thickness of the cleaning belt 30*a* in a free state. The sewage water and excess water on the cleaning belt 30*a* are squeezed into the sewage collection tank 70*a* by the interaction of the water squeezing roller 90*a* and the convex portion 71*a*.

When the cleaning device cleans the ground, the driving roller 10, 10*a* drives the cleaning belt 30, 30*a* under the driving force of the driving motor, and the cleaning belt 30, 30*a* is close to the ground. The cleaning belt 30, 30*a* sweeps the garbage on the ground toward the garbage collection box 50, 50*a*, and the cleaning belt 30, 30*a* cooperates with the guide plate 51, 51*a* to guide the garbage into the garbage collection box 50, 50*a*. The brush 60, 60*a* is used for sweeping the lighter garbage adsorbed on the cleaning belt 30, 30*a* into the garbage collection box 50, 50*a*. The clean water tank 80, 80*a*, cleans the cleaning belt 30, 30*a*, and the sewage water and excess water are squeezed into the sewage collection tank 70, 70*a* by the water squeezing roller 90, 90*a*. The tightness of the cleaning belt 30, 30*a* can be adjusted by adjusting the position of the tension roller, thereby, the moisture content of the cleaning belt 30, 30*a* is adjusted.

The cleaning device of the present disclosure is provided with a sewage collection tank 70, 70*a* and a clean water tank 80, 80*a*, When the cleaning device performs a cleaning operation, clean water in the clean water tank 80, 80*a* flows onto the cleaning belt 30, 30*a* to clean the cleaning belt 30, 30*a*, and the cleaning belt 30, 30*a* is passed through the water squeezing roller 90, 90*a*. The sewage water and excess water are squeezed into the sewage collection tank 70, 70*a* the cleaning belt 30, 30*a* is kept clean, and the moisture content of the cleaning belt 30, 30*a* is maintained. The cleaning belt 30, 30*a* is not required to be manually cleaned, which is advantageous for reducing the labor intensity. The cleaning of the ground can be completed during a single cleaning session and the cleaning time is shortened, which is beneficial to improve the cleaning efficiency of the cleaning device. The sewage collection tank 70, 70*a* is used for storing the sewage water after cleaning the cleaning belt 30, 30*a*, and the clean water tank 80, 80*a* is used for storing clean water to ensure the cleanliness of the cleaning belt 30, 30*a*. It is beneficial to improve the cleaning efficiency when cleaning the ground. By arranging the cleaning belt in a ring shape, the cleaning efficiency is improved and the service life is extended.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this manual.

The above-described embodiments are merely illustrative of several embodiments of the present disclosure, and the description thereof is more specific and detailed, but is not to be construed as limiting the scope of the disclosure. It should be noted that a number of variations and modifications may be made by those skilled in the art without departing from the spirit and scope of the disclosure. Therefore, the scope of protection of the present disclosure shall be subject to appended claims.

The invention claimed is:

1. A cleaning device, comprising:
a driving roller;
a driven roller;
a flexible cleaning belt sleeved on the driving roller and the driven roller;
a garbage collection box disposed on one side of the flexible cleaning belt;
a brush disposed above the garbage collection box;
a sewage collection tank;
a clean water tank; and
a first water squeezing roller, wherein:
the garbage collection box is provided with a guide plate,
the guide plate faces an outer side of the flexible cleaning belt,
the sewage collection tank and the clean water tank are both located downstream of the garbage collection box along a moving direction of the flexible cleaning belt, and
the first water squeezing roller is adjacent to the sewage collection tank.

2. The cleaning device according to claim 1, comprising:
a first tension roller, wherein:
the first tension roller is located between the driving roller and the driven roller, and
the flexible cleaning belt is at least partially wound around the first tension roller.

3. The cleaning device according to claim 2, comprising:
a second tension roller wherein:
the first tension rover is in contact with an inner side of the flexible cleaning belt opposite the outer side of the flexible cleaning belt, and
the second tension roller is in contact with the outer side of the flexible cleaning belt.

4. The cleaning device according to claim 1, comprising:
a load bearing wheel disposed under the garbage collection box.

5. The cleaning device according to claim 1, wherein the brush is a roller brush.

6. The cleaning device according to claim 5, wherein:
the roller brush is sleeved on a rotating roller, and
one end of the rotating roller is connected to a rotating motor.

7. The cleaning device according to claim 1, wherein:
the sewage collection tank is located below the flexible cleaning belt,
the flexible cleaning belt is disposed between the sewage collection tank and the clean water tank.

8. The cleaning device according to claim 1, wherein:
the sewage collection tank and the clean water tank are both located above the flexible cleaning belt, and
the sewage collection tank is located downstream of the clean water tank along the moving direction of the flexible cleaning belt.

9. The cleaning device according to claim 8, wherein:
the sewage collection tank is connected to a water pump.

10. The cleaning device according to claim 1, wherein the sewage collection tank is provided with a water inlet hole facing the flexible cleaning belt.

11. The cleaning device according to claim 10, wherein one end of the sewage collection tank is provided with a water outlet.

12. The cleaning device according to claim 1, wherein:
the clean water tank is provided with a water outlet hole facing the flexible cleaning belt, and
one end of the clean water tank is provided with a water inlet.

13. The cleaning device according to claim 1, comprising:
a second water squeezing roller, wherein the flexible cleaning belt is disposed between the first water squeezing roller and the second water squeezing roller.

14. The cleaning device according to claim 1, wherein:

the sewage collection tank has a convex portion facing the flexible cleaning belt, the flexible cleaning belt is between the first water squeezing roller and the sewage collection tank, and the first water squeezing roller is vertically aligned with the convex portion of the sewage collection tank.

15. The cleaning device according to claim 1, wherein the guide plate has a sharp corner facing away from the garbage collection box.

16. The cleaning device according to claim 1, wherein the guide plate has a curved surface.

17. A cleaning device, comprising:

a driving roller;

a driven roller;

a flexible cleaning belt sleeved on the driving roller and the driven roller;

a garbage collection box disposed on one side of the flexible cleaning belt;

a brush disposed above the garbage collection box and in contact with the flexible cleaning belt;

a sewage collection tank; and a clean water tank, wherein the sewage collection tank and the clean water tank are both located downstream of the garbage collection box and the brush along a moving direction of the flexible cleaning belt.

18. The cleaning device of claim 17, wherein the flexible cleaning belt is disposed between the clean water tank and the sewage collection tank.

19. The cleaning device of claim 17, wherein:

the clean water tank comprises a water outlet hole facing the sewage collection tank, and the sewage collection tank comprises a water inlet hole facing the clean water tank.

* * * * *